United States Patent [19]

Hellgren

[11] Patent Number: 4,693,103

[45] Date of Patent: Sep. 15, 1987

[54] FORMING PRESS OF THE PRESSURE CELL TYPE AND A PROCESS FOR CHANGING DIAPHRAMS IN SUCH A PRESS

[75] Inventor: Keijo Hellgren, Västeras, Sweden

[73] Assignee: ASEA AB, Västeras, Sweden

[21] Appl. No.: 853,953

[22] Filed: Apr. 21, 1986

[30] Foreign Application Priority Data

Mar. 4, 1986 [SE] Sweden ..... 8600973

[51] Int. Cl.[4] ..... B21D 22/12

[52] U.S. Cl. ..... 72/63; 72/56; 72/446; 29/421 R

[58] Field of Search ..... 72/63, 60, 54, 56, 709, 72/446, 448; 29/421 R; 425/DIG. 19, DIG. 112, 384, 405 R

[56] References Cited

U.S. PATENT DOCUMENTS

| | | | |
|---|---|---|---|
| 2,848,968 | 8/1958 | Novak | 72/63 |
| 2,962,994 | 12/1960 | Wheelon | 72/63 |
| 4,573,335 | 3/1986 | Persson | 72/63 |

*Primary Examiner*—Robert L. Spruill
*Assistant Examiner*—David B. Jones
*Attorney, Agent, or Firm*—Watson, Cole, Grindle & Watson

[57] ABSTRACT

A forming press of the pressure cell type comprising a press stand with two opposing force absorbing elements defining between them a working space into which a trough with forming tools and workpiece can be inserted; a press plate in communication with a pressure medium source; a diaphragm forming together with the press plate an expansible pressure cell; and side pieces extending along the side surfaces of the working space while keeping the diaphragm in abutment against a sealing ring disposed around the periphery of the diaphragm, said sealing ring in turn abutting against the press plate, providing thereby a quicker and simpler diaphragm exchange as compared to prior art constructions by the side pieces being turnable so that when upwardly swung, their long sides abut against the underside of the diaphragm, and by means for moving the unit formed of upwardly swung side pieces and diaphragm out of the working space; the invention also including a process for changing diaphragms in said forming press.

8 Claims, 6 Drawing Figures

FORMING PRESS OF THE PRESSURE CELL TYPE AND A PROCESS FOR CHANGING DIAPHRAMS IN SUCH A PRESS

The present invention relates to a forming press of the pressure cell type and a process for the exchange of diaphragms in such a press. Presses of this type are frequently used in today's manufacture of complicated sheet metal parts in relatively small series, for example in the aircraft industry and in the manufacture of prototype components in the automobile industry.

Presses of this type comprise a press stand having two opposing force absorbing elements defining between them a working space into which can be inserted a carrier member such as a trough carrying a forming tool and a workpiece; a press plate which is in communication with a pressure medium source; a diaphragm forming together with the press plate an expansible pressure cell; and side pieces extending along the side surfaces of the working space while keeping the diaphragm in abutting contact with the press plate. These presses function well, but owing to the high pressure prevailing in the pressure cell and exceeding sometimes 100 MPa, the diaphragm will be exposed to appreciable wear and must therefore be replaced at regular intervals. In previous designs with the diaphragm fixed by screws to the press plate, replacement would involve a period of five working days. Because diaphragms of this type need as a rule be shifted at intervals of four weeks, it is easily understood that substantial advantages are gained with the use of a diaphragm construction affording lower manufacturing costs and simpler replacement in comparison with the construction referred to above.

An improved diaphragm construction with regard to cost and manufacture is described in U.S. patent application Ser. No. 823,326 now U.S. Pat. No. 4,658,618 commonly owned herewith. According to this construction, the diaphragm is clamped between a press plate and two side pieces carrying the diaphragm on their upper sides.

The side pieces are in turn retained at their lower ends towards the side surfaces of the working space by means of a plate arranged at the bottom of the working space, said plate extending along the side portions over the entire width of the bottom area. Because the diaphragm in such a construction is not screwed to the press plate, the exchange of diaphragm is facilitated as compared to prior art constructions; the mounting and dismounting operations however still being extremely time-consuming.

The object of the present invention is to achieve a forming press of the aforesaid type, enabling a simplified and less time-consuming exchange of diaphragm is comparison with conventional methods.

For this purpose, a press of the type mentioned above and having a diaphragm construction of the kind set forth in the said U.S. patent application is distinguished according to the invention in that the side pieces are pivotable, so that in an upwardly swung position their long sides will abut against the underside of the diaphragm, and that means are arranged for the unit formed of the upwardly turned side pieces and the diaphragm carried thereby to be brought out of the working space.

In the most common design existing at present, the press plates comprise end support elements made integral with the press plates and necessitating for the diaphragm to be lowered before being drawn out of the working space. The preferred embodiment of the invention therefore includes means for vertical displacement of the combined diaphragm and side pieces before this assembly is taken out of the working space.

With this design of a forming press, the diaphragm exchange process can be carried out by swinging the side pieces upwardly from a substantially vertical to a substantially horizontal position, whereby the diaphragm to be replaced will be supported by the long sides of the side pieces. And, the side pieces with the diaphragm are brought out, as a unit out, of the working space of the press and up to an exchange station where the worn diaphragm is replaced by a new one, the unit formed of the side picese and the new diaphragm thereafter being introduced into the working space of the press and the side pieces being swung downwardly to a substantially vertical position. The inventive press employed in the process according to the invention allows for a diaphragm to be replaced in no more than 5–6 hours, which represents a considerable saving in time as compared to diaphragm exchange operations known so far.

In the subclaims, reference is made to a preferred embodiment of the invention according to which the transport track for the trough is utilized for taking the unit composed of side pieces and diaphragm out of the working space.

In order to facilitate the understanding of the inventive concept, a preferred embodiment will be described with reference to the accompanying drawings, of which FIG. 1 is a schematic side view of a plant provided with a forming press according to the invention;

Figure 1:
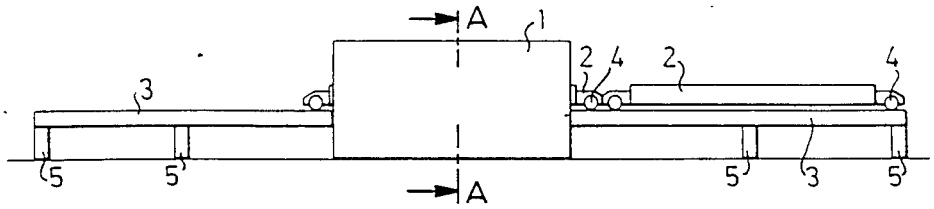

FIG. 1 illustrates schematically a press plant with a press stand 1 having a working space into which a trough 2 is insertable. In the embodiment shown, the trough 2 carrying the workpieces and forming tools is provided with wheels 4 running on rails on a transport track 3 supported by a column 5. The transport track for the trough can of course be given any arbitrary design such as a conveyor belt, for example.

The press stand 1 is suitably provided with a prestress wire-wound mantle 10, enabling it in this manner to absorb the high working pressures requried for difficultly-workable sheet material. Inside this mantle 10, the press stand incorporates two yokes 11 and 12 which, together with two intermediate spacers possibly forming an integrated part thereof, constitute a through-passing working space defined by horizontal, straight walls in the upper and lower yoke, and arc-shaped vertecal walls in each spacer. The upper part of the working space accommodates a press plate 20 in which are formed one or more channels 25, 29 opening out into the bottom of the press plate while being i communication with a pressure medium source. This plate 20 is secured in a suitable manner to the yoke 11. Located beneath the press is a double-layered diaphragm 22 which has a sealing ring 23 extending around its upper periphery. Along either long side of the working space, the diaphragm 22 rests on side pieces 40,41 situated inside the working space, said side pieces having on their support surfaces longitudinal, upwardly projecting beads 53 fitting into matching grooves 52 made in the underside of the diaphragm edge. In a corresponding manner, end protions 42 (see FIG. 3) extending along the short sides of the diaphragm are provided with beads 55 for coaction with the peripheral groove 52; these end portions 42 as well resting on the side pieces 40,41 suitably with the aid of lifting pistions arranged in recesses on the side pieces in a manner similar to that described in the aforementioned patent application. In order for the side pieces in the working space of the press to be held in a fixed position, three wedge plates 45, 46, 47 are disposed on the bottom of the working space, that is on the upper side of the yoke; the two outermost plates thereby abutting against the lower edge of either long side of the side pieces.

Figure 2:
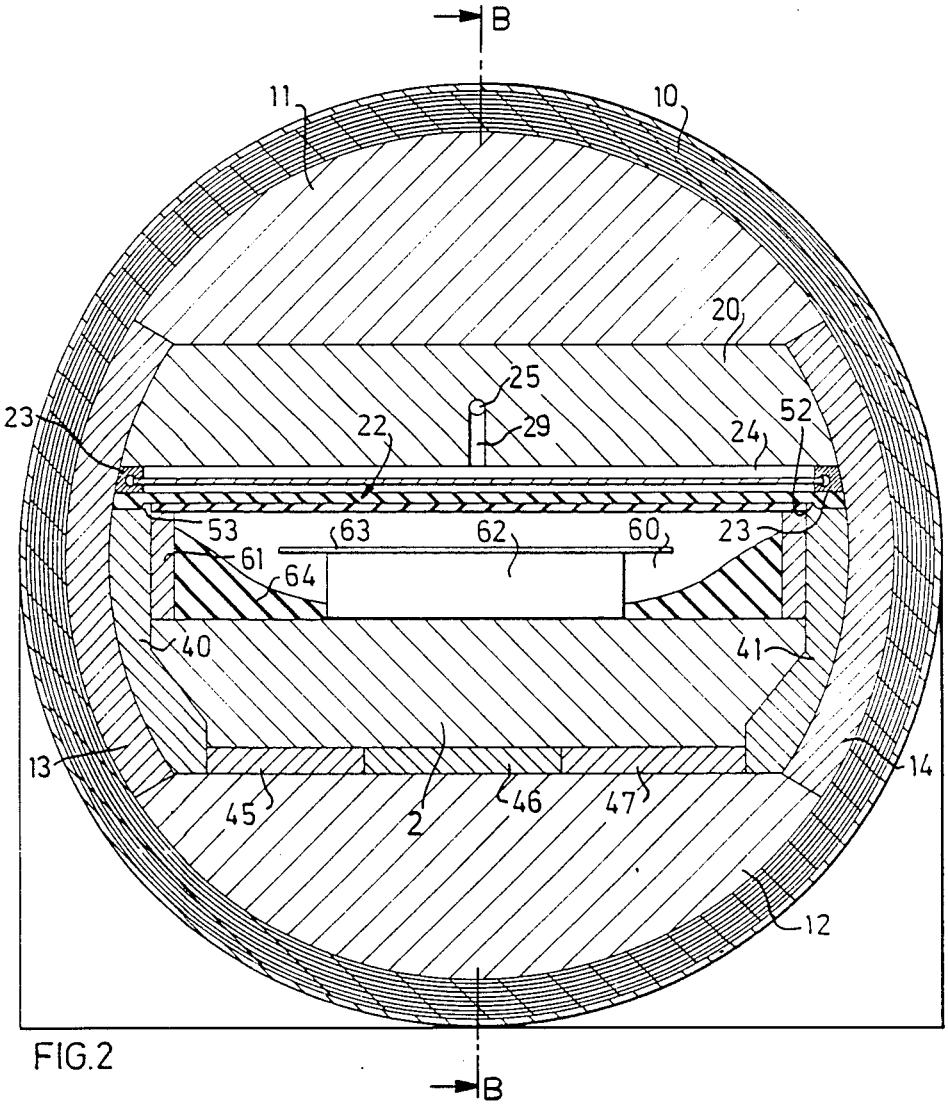
FIG. 2 is a cross section taken on the line A—A in FIG. 1.
Figure 3:
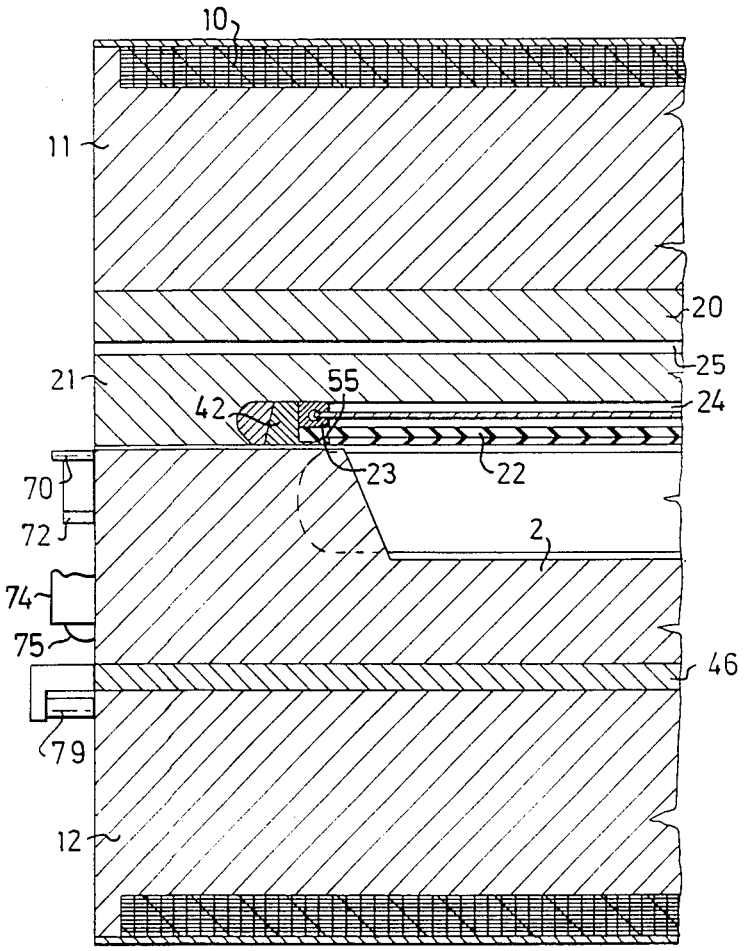
FIG. 3 is a section of an end portion of the inventive press taken along the plane B—B in FIG. 2.

FIGS. 2 and 3 illustrate the press with the trough 2 introducted into the working space. In a conventional manner, this trough is designed with loose side walls 61. On the bottom of the trough there are placed one or more forming tools 62 with plates 63 to be shaped resting thereon. Suitable filling pieces are laid in between the forming tools. Beyond the end portions 42 there are arranged longitudinally oriented end support members 21 which can either be made integral with the press plate 20 as indicated by reference numeral 21, or be made as separate parts which are prevented in a manner not shown from axial displacement during a pressing operation. Together with the press plate 20 and the end support members 21, the trough will thus form a closed press chamber 60; the diaphragm 22 together with the press plate thereby forming a closed pressure cell 24.

Figure 4:
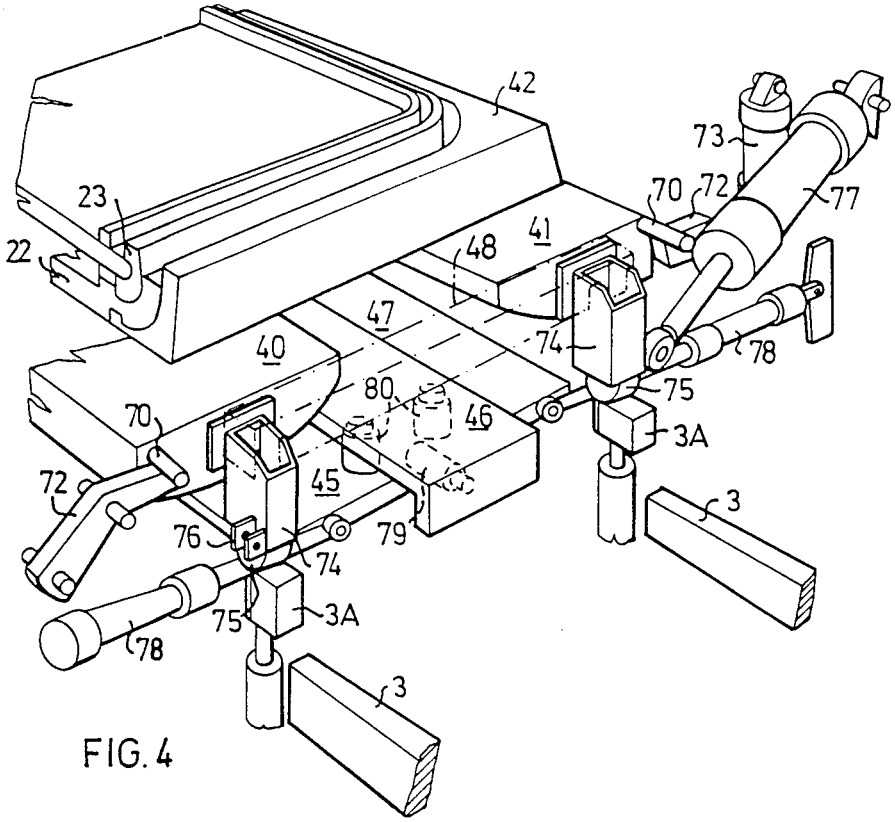
FIG. 4 is a schematic view of the unit comprising upwardly turned side pieces and diaphragm, and the members for taking this unit out of the working space of the press.

FIG. 4 schematically illustrates the means for facilitating diaphragm exchange at one short side of the press. Corresponding means are arranged at the opposing short side of the press stand.

Figure 5A:
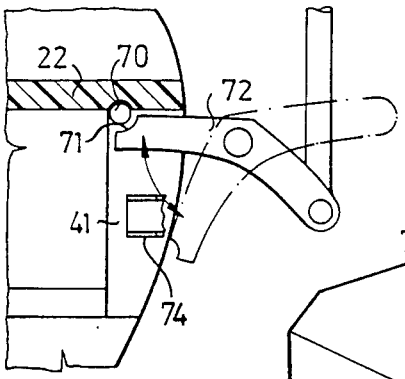
FIGS. 5*a* and 5*b* are schematic views showing some of the members indicated in FIG. 4.

As shown in FIG. 4 there is disposed on each short side or end face of the side pieces a pivot pin 70 projecting longitudinally from the upper side and extending outside each short side of the press stand. This pivot pin coacts with a shaft support 71 formed in the illustrated embodiment on one end of a pivotally journalled arm 72 the other end of which is operated by a hydraulic cylinder 73 so that form the position shown in FIG. 4 in which the shaft support together with the pivot pin constitutes a swivel, the arm 72 can be swung to an idle position where the arm 72 does not prevent withdrawal of the side pieces fom the working space, as is indicated wtih dash-dotted lines in FIG. 5*a* .

Figure 5B:
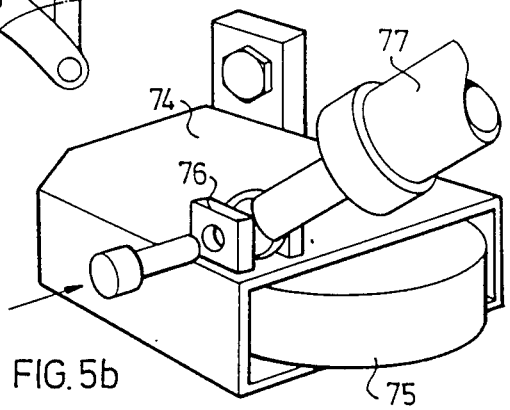

There are further arranged on each short side or end face of the side pieces support members 74 intended to carry the upwardly swung side pieces on a transport track upon withdrawal of the side pieces from the working space. For this purpose the support members are provided with wheels 75. The support members 74, consisting of a rectangular tube in the illustrated embodiment, are furthermore provided with coupling flanges 76 for engagement with the piston rod of a hydraulic cylinder 77, as is indicated in FIG. 5*b*. By activating this hydraulic cylinder, together with a corresponding hydraulic cylinder disposed on the opposing short side (not shown) of the press stand, the side piece will be swung upwards.

As previously mentioned, the side pieces when mounted are secured in the working space by means of wedge plates 45,46,47. For allowing upward swinging of the side pieces, the wedge plates must either be taken out of the working space, or they must be displaced towards the center of the working space bottom. In the preferred embodiment, the two outer wedge plates 45 and 47 are displaceable by means of hydraulic cylinders 78, whereas the middle wedge plate 46 can be displaced longitudinally by means of a hydraulic cylinder 79 and vertically by means of hydraulic cylinders 80.

For the sake of clarity, the press stand is not shown in FIG. 4 as are neither the attachment means for the swinging arms 72 nor the hydraulic cylinders 73, 77 and 78. The attachment can be made on components projecting from the short sides of the press stand 1, or on individual stands.

Finally, the transport track for the side pieces, which in the illustrated embodiment is identical to the track 3 intended for the trough but which can also be a separate track, comprises rail sections 3A verticallly displaceable into abutting contact with the wheels 75 of the support members 74 in the upwardly turned position of the side pieces.

Replacement of a diaphragm takes place in the following manner.

After withdrawal of the trough from the working space, the swivels of the side pieces are established by actuating the cylinders 73; the shaft supports 71 thereby supporting the pivot pins 70 of the side pieces. (The position of the arm 72 is indicated by solid lines in FIG. 5*a*.) Simultaneously with, or in a sequence immediately following this step, the middle wedge plate 46 is loosened by means of the cylinder 79 and is then lifted from the working space bottom by means of the cylinders 80. The outer wedge plates 45 and 47 can now be displaced towards the center of the working space bottom by means of the cylinders 78, whereafter the cylinders 77 joined to the support members 74 are actuated, causing in this manner the side pieces to pivot about the swivels 70,71. With the side pieces in this position, the diaphragm 22 and the end pieces 42 will be supported by the long sides of the side pieces. After the side pieces have been swung upwards, the rail sections 3A are vertically displaced into abutment against the wheels 75 of the support members 74. The load of the unit formed of side pieces 40,41, diaphragm 22 and end portions 42 will now rest on four rail sections 3A. In order to provide sufficient lateral stability for said unit, the support members disposed at either short side are suitably interconnected with the use of an appropriate connecting means such as, for example, a transverse U-beam 48 provided with recesses as indicated in phantom outline in FIG. 4. At this stage in the diaphragm exchange process, the dismantling means will assume the positions shown in FIG. 4.

The piston rods of the hydraulic cylinders 77 are now disconnected from the support members 74, and the shaft supports 71 are brought to their idle position. The rail sections 3A with the unit resting thereon are then lowered down to a point where the sections 3A come into alignment with the remaining part of the transport track 3. It should be observed in this context that the unit must of course be lowered far enough for the upper defining surface of the diaphragm to be thrust in under the end support members 21 of the press plate. In addition, the extension of the rail sections 3A should be sufficient for bridging the entire gap between the short sides of the outer wedge plates and the remaining part of the transport track 3.

The unit resting on the support members is finally drawn out of the working space and brought along the transport track up to a diaphragm exchange station where the worn diaphragm is replaced by a new one.

When inserting the unit resting on the support members after exchange of diaphragms, the procedure described above is carried out in reversed order.

With the inventive construction, replacement of a diaphragm can take place much more rapidly and using simpler dismantling tools than with prior art constructions. Beyond the dismounting and mounting means mentioned, there is required in principle only a hoist for lifting up the worn diaphragm from the side pieces at the exchange station for shifting to a new diaphragm. Hoists of this type such as travelling cranes, for example, are commonly used in this kind of industrial localities. Since a hoist for use in a diaphragm shifting operation according to the invention is needed only occasionally and during a rather short period of time, the diaphragm shifting operation will interfere very little with the work of such a hoist.

A plurality of modifications are conceivable within the scope of the invention. For example, the shaft support control mechanism can be made linearly displaceable, and the attachment point of the swinging mechanism with the side pieces can be located at the lower side piece edge instead of in the support members. Furthermore, the unit comprised of diaphragm and side pieces need not be lowerable unless the end support members 21 are integrated with the press plate. Therefore, the embodiment described herein should not be regarded as restricting the scope of the invention but should solely be decisive of the concept as set forth in the appended claims.

I claim:

1. A forming press of the pressure cell type, comprising a press stand with two opposing pressure absorbing elements defining between them a working space into which a trough for supporting forming tools and a workpiece is insertable; a press plate in communication with a pressure medium source; a diaphragm forming together with the press plate an expansible pressure cell; and side pieces extending along the side surfaces of the working space and retaining the diaphragm in abutting contact with a sealing ring disposed around the periphery of the diaphragm, said side pieces having long sides and end faces, and said ring abutting against the press plate, the side pieces being pivotable into an upwardly swung position so that said long sides thereof abut against the underside of the diaphragm, longitudinal pivot pins projecting outwardly of said end faces, arms pivotally journalled on said press having shaft supports in engagement with said pivot pins so as to define swivels for the side pieces upon pivotable movement thereof, the arms being pivotable into a position out of interference with the side pieces to permit the removal of the unit, and swinging mechanisms mounted on the press and detachably connected to the side pieces for pivoting the side pieces into the upwardly swung position about said swivels, the upwardly swung side pieces and the diaphragm resting thereon comprising a unit removable from the working space, and means on the side pieces for guiding the unit upon removal.

2. A press according to claim 1, further comprising a transport track having guide rails located outside the press stand, the guiding means resting on the guide rails during removal of the unit, said guiding means comprising support members affixed to the end faces of the side pieces.

3. A press according to claim 2, wherein means are provided on the press for vertical displacement of the unit from a first position where said unit is connectible with the shaft supports and the swinging mechanism, to a second position where the support members are aligned with the transport track, the shaft supports during removal of the unit between these positions being in the out of interference position, and the swinging mechanisms being detached from the side pieces.

4. A press according to claim 3, wherein three wedge plates extend together over the entire bottom area of the working space; the side pieces respectively abutting against outer edges of the outermost ones of the wedge plates, and each of the wedge plates being removable from the working space bottom to allow for a swinging movement of the side pieces.

5. A process of changing the diaphragm in a forming press of the pressure cell type, the press comprising a press stand with two opposing pressure absorbing elements defining between them a working space into which a trough for supporting forming tools and a workpiece is insertable, a press plate in communication with a pressure medium source, a diaphragm forming together with the press plate an expansible pressure cell, and vertically disposed side pieces extending along the side surfaces of the working space and retaining the diaphrgam in abutting contact with a sealing ring disposed around the periphery of the diaphragm, the side pieces having long sides and end faces, the ring abutting against the press plate, the process comprising the steps of upwardly swinging the side pieces about longitudinal axes thereof from a substantially vertical to a substantially horizontal position such that the diaphragm to be replaced is supported by the long sides of the side pieces, and withdrawing the side pieces and the diaphragm together as a unit from the working space to an exchange station for replacing the diaphragm when worn with a new one, and inserting the new diaphragm and the side pieces as a unit into the working space after swinging the side pieces downwardly to the substantially vertical position.

6. The process according to claim 5, wherein the press stand further comprises three wedge plates extending together over the entire bottom area of the working space, the side pieces respectively abutting against the outer sides of the outermost one of the plates, the upwardly swinging step comprising:

projecting pivot pins outwardly of the end faces;

journalling, on the press, pivotable arms having shaft supports in engagement with the pivot pins to define swivels about which the side pieces swing;

elevating the middle one of said wedge plates within the working space, and thereafter displacing the outermost wedge plates toward the center of the working space bottom; and swinging the side pieces to the horizontal position by actuating swinging mechanisms connected to the side pieces.

7. The process according to claim 6, wherein the forming press includes a transport track having guide rails located outside the press stand, the withdrawing step comprising:

connecting support members to the end faces of the side pieces;

upwardly displacing rail sections into abutment against the support members;

disconnecting the swinging mechanisms from the side pieces and pivoting the arms away from the side pieces;

lowering the rail sections into alignment with the rails; and withdrawing the first mentioned unit from the working space and moving the same along the transport track to the exchange station.

8. The process according to claim 6, wherein the inserting step comprises:

moving the second mentioned unit from the exchange station into the working space until the support members overlie the rail sections;

upwardly displacing the rail sections until the diaphragm sealingly contacts the underside of the press plate;

engaging the shaft supports with the pivot pins, and coupling the swinging mechanisms to the side pieces;

lowering the rail sections into alignment with the transport track;

swinging the side pieces to the vertical position by actuating the swinging mechanisms; and returning the wedge plates so as to extend over the entire bottom area of the working space.

* * * * *